US007743800B1

(12) United States Patent
Cole

(10) Patent No.: US 7,743,800 B1
(45) Date of Patent: Jun. 29, 2010

(54) CONTAINER ASSEMBLY FOR UNCONTAMINATED INSERTION OF MATERIAL

(76) Inventor: Nathan Albert Cole, 7770 Regents Rd., Suite 113-179, San Diego, CA (US) 92122

( * ) Notice: Subject to any disclaimer, the term of this patent is extended or adjusted under 35 U.S.C. 154(b) by 623 days.

(21) Appl. No.: 11/635,744

(22) Filed: Dec. 7, 2006

Related U.S. Application Data

(62) Division of application No. 11/005,464, filed on Dec. 6, 2004, now Pat. No. 7,146,781.

(51) Int. Cl.
*B65D 1/40* (2006.01)
*B65D 25/22* (2006.01)
*B65B 3/04* (2006.01)

(52) U.S. Cl. ..... 141/329; 220/729; 220/751; 222/180

(58) Field of Classification Search ..... 141/329; 220/694, 729, 751; 222/180
See application file for complete search history.

(56) References Cited

U.S. PATENT DOCUMENTS 4,452,030 A 6/1984 Inada
4,489,769 A 12/1984 Catelli
4,805,378 A * 2/1989 Anderson ..... 53/426
4,916,885 A 4/1990 Loliger
4,942,716 A 7/1990 Anderson
5,069,366 A 12/1991 Graffin
5,669,208 A 9/1997 Tabaroni et al.
5,884,457 A 3/1999 Ortiz et al.
6,230,472 B1 5/2001 Stahlecker
6,256,964 B1 7/2001 Drevfors
6,308,847 B1 * 10/2001 Andersson et al. ..... 215/247
6,322,739 B1 11/2001 Andersson et al.
6,398,771 B1 6/2002 Gustafsson et al.
6,471,459 B2 10/2002 Blonigan et al.
6,483,222 B2 11/2002 Pelrine et al.
6,595,391 B1 * 7/2003 Anderson ..... 222/83.5
6,604,561 B2 * 8/2003 Py ..... 141/329
6,623,455 B2 9/2003 Small et al.
6,666,003 B1 12/2003 Allais et al.
6,699,229 B2 3/2004 Zinger et al.
6,712,202 B2 3/2004 Muller et al.
6,719,733 B1 4/2004 Heffernan et al.
6,779,318 B2 8/2004 Wang
6,945,417 B2 * 9/2005 Jansen et al. ..... 215/249
7,028,857 B2 * 4/2006 Peronek ..... 215/40
7,128,105 B2 * 10/2006 Tribble et al. ..... 141/319
2004/0134373 A1 7/2004 Guenther et al.
2007/0068598 A1 * 3/2007 Rodewald ..... 141/301

* cited by examiner

*Primary Examiner*—Gregory L Huson
*Assistant Examiner*—Nicolas A Arnett
(74) *Attorney, Agent, or Firm*—Edward W. Callan

(57) ABSTRACT

Sensitive materials are packaged by being inserted into an uncontaminated reservoir of a container assembly without being contaminated during such packaging. The container assembly also includes an uncontaminated sleeve and an uncontaminated film. A lower portion of the sleeve extends from opening in the top of the reservoir and an upper portion of the sleeve is sealed by the film. When the film is broken, the material is inserted into the reservoir. The upper portion of the sleeve is separable from the lower portion of the sleeve. The container assembly also includes a first set of carrier arms attached to the upper portion of the sleeve for facilitating movement of the carrier assembly and a second set of carrier arms attached to the reservoir for facilitating handling and/or movement of the reservoir after the upper portion of the sleeve is separated from the lower portion of the sleeve.

19 Claims, 5 Drawing Sheets

CONTAINER ASSEMBLY FOR UNCONTAMINATED INSERTION OF MATERIAL

CROSS-REFERENCE TO RELATED APPLICATION

This is a divisional of U.S. patent application Ser. No. 11/005,464 filed Dec. 6, 2004, which is to issue on Dec. 12, 2006 as U.S. Pat. No. 7,146,781.

BACKGROUND OF THE INVENTION

The present invention generally pertains to packaging of materials and is particularly directed to inserting material into an uncontaminated container reservoir.

The term "material" includes any material in any state or form, including manufactured, intermediate and raw materials, and further includes either a discrete material or a mixture of different discrete materials. Examples of materials that are inserted into uncontaminated containers include foods and drugs, which may be in either a fluid or a solid state. The term "uncontaminated" is used herein in the sense that an object that is uncontaminated does not carry a foreign material that would contaminate the material that is being inserted into a container reservoir. In the art, the terms "sterile", "aseptic" and "clean" sometimes are used to describe both uncontaminated container components and uncontaminated environments.

SUMMARY OF THE INVENTION

The present invention provides a container assembly comprising: an uncontaminated reservoir; an uncontaminated sleeve; and an uncontaminated film; wherein there is an opening at the top of the reservoir; wherein the sleeve has a lower portion that extends from the reservoir opening and an upper portion that is sealed by the film; wherein penetration of the film to break the seal thereby opens the sleeve and enables insertion of a material into the uncontaminated reservoir; and wherein the upper portion of the sleeve is sealed by the film at a time when the material has not yet been inserted into the uncontaminated reservoir.

The present invention also provides a container assembly comprising: an uncontaminated reservoir; an uncontaminated sleeve; carrier arms attached to a portion of the sleeve for facilitating movement of the carrier assembly via a set of tracks; and an uncontaminated film; wherein there is an opening at the top of the reservoir; wherein the sleeve has a lower portion that extends from the reservoir opening and an upper portion that is sealed by the film; wherein penetration of the film to break the seal thereby opens the sleeve and enables insertion of a material into the uncontaminated reservoir; and wherein the reservoir is separable from the portion of the sleeve to which the first recited carrier arms are attached, the container assembly further comprising: a second set of carrier arms attached to the reservoir for facilitating handling and/or movement of the reservoir via a set of tracks after the reservoir is separated from the portion of the sleeve to which the first recited carrier arms are attached.

The present invention further provides a container assembly comprising: an uncontaminated reservoir; an uncontaminated sleeve; and an uncontaminated film; wherein there is an opening at the top of the reservoir; wherein the sleeve has a lower portion that extends from the reservoir opening and an upper portion that is sealed by the film; wherein penetration of the film to break the seal thereby opens the sleeve and enables insertion of a material into the uncontaminated reservoir; and wherein an upper portion of the sleeve is sealed to a collar and the film is secured to the collar by a ring that is sealed within a step at the uppermost portion of the collar, the step being of a wider diameter than an adjoining lower portion of the collar so that the upper portion of the sleeve is sealed by the film.

The reservoir and the sleeve are uncontaminated if at least the interior of the reservoir and the interior of the sleeve are uncontaminated.

The present invention enables very sensitive materials, such as parenteral medications, to be reliably packaged by being inserted into a container reservoir without being contaminated during such packaging.

Additional features of the present invention are described with reference to the detailed description of the preferred embodiments.

DETAILED DESCRIPTION

Figure 1:
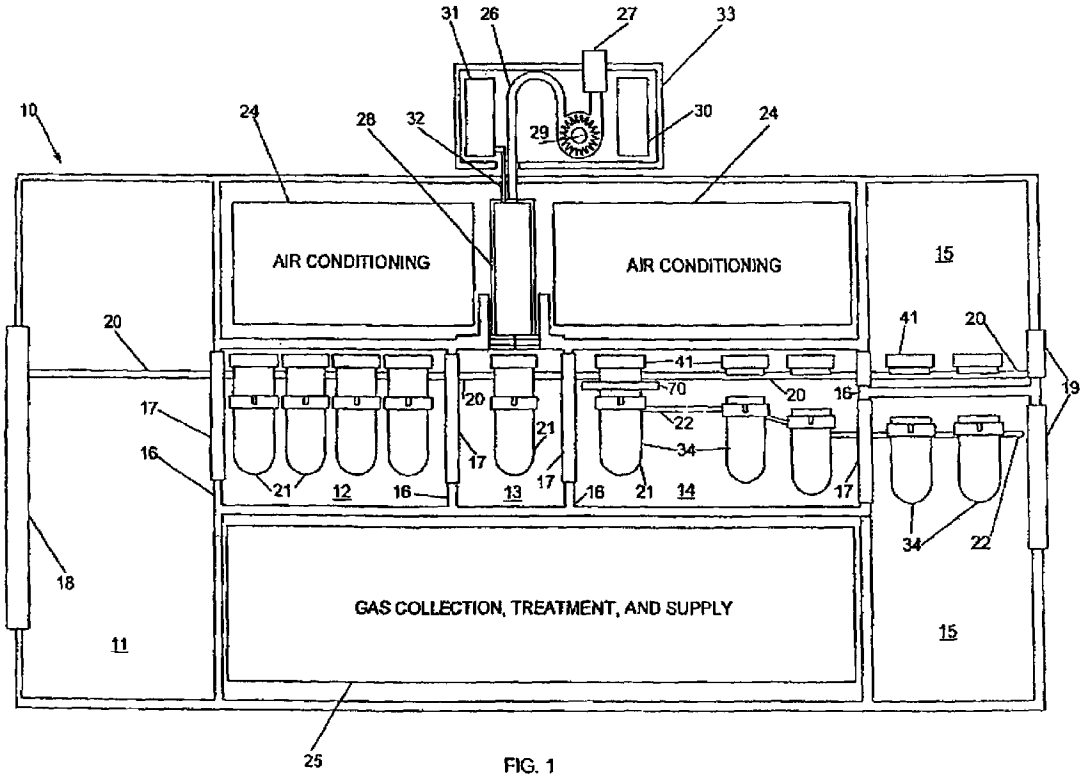
FIG. 1 is a functional diagram of a confined structure for facilitating insertion of a material into an uncontaminated container reservoir in accordance with a preferred embodiment of the present invention.
Figure 5:
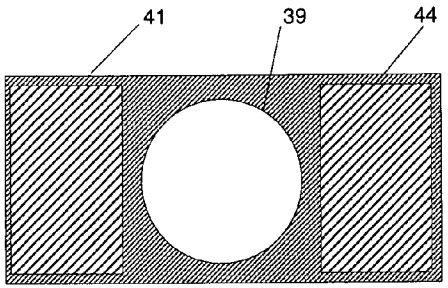
FIG. 5 is a top sectional view of an upper portion of the container assembly of FIG. 2, taken along line 5-5 in FIG. 2.
Figure 6:
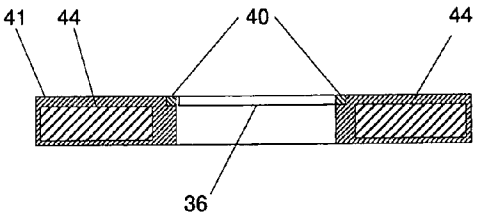
FIG. 6 is an end sectional view of the upper portion of the container assembly of FIG. 2, taken along line 6-6 in FIG. 3.
Figure 3:
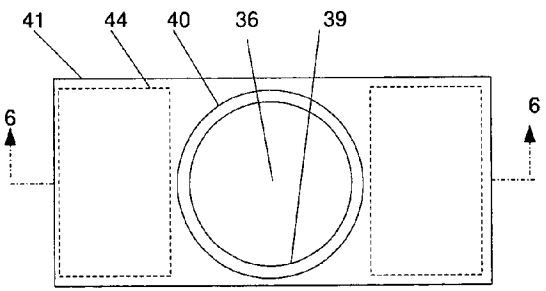
FIG. 3 is a top view of the container assembly of FIG. 2.
Figure 2:
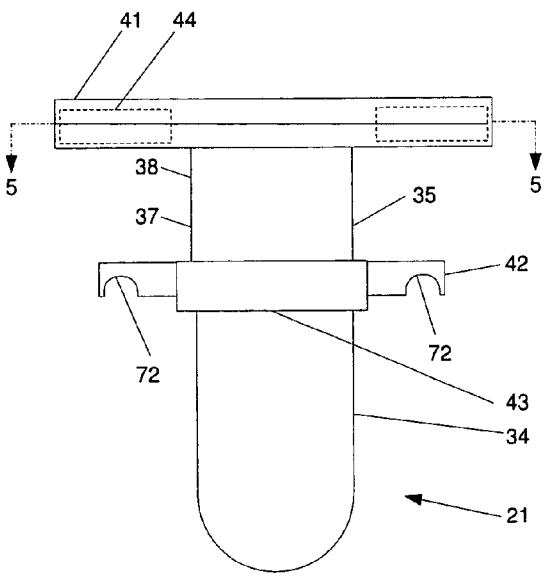
FIG. 2 is an end view of a container assembly according to a preferred embodiment of the present invention; wherein said assembly includes a reservoir into which a material is inserted within the structure shown in FIG. 1.
Figure 4:
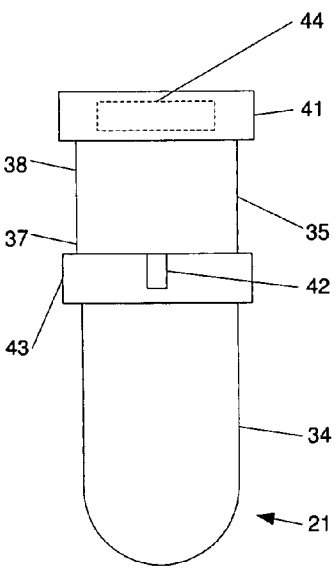
FIG. 4 is a side view of the container assembly of FIG. 2.

Referring to FIG. 1, a preferred embodiment of a confined structure 10 according to the present invention for facilitating insertion of a given liquid material, such as a parenteral medication, into an uncontaminated container reservoir contains a loading chamber 11, a staging chamber 12, a filling chamber 13, a sealing chamber 14 and an unloading chamber 15. These five chambers 11, 12, 13, 14, 15 are separated by interior walls 16 containing doors 17.

Doors 18 and 19 in the exterior walls of the confined structure 10 respectively provide access to the loading chamber 11 and the unloading chamber 15 from outside the confined structure 10. The doors 17, 18, 19 can be selectively sealed to provide airlocks within the loading chamber 11, the staging chamber 12, the filling chamber 13, the sealing chamber 14 and the unloading chamber 15, or within adjacent sets of such chambers 11 and 12, 12, 13 and 14, and 14 and 15 when the door 17 between the respective adjacent set of chambers is opened.

A first set of tracks 20 is disposed in the confined structure 10 for facilitating movement of container assemblies 21 into the staging chamber 12 from the loading chamber 11, into the filling chamber 13 from the staging chamber 12, and into the sealing chamber 14 from the filling chamber 13. The first set of tracks 20 further extends into the unloading chamber 15 from the sealing chamber 14; and a second set of tracks 22 also extends into the unloading chamber 15 from the sealing chamber 14.

Container assemblies 21 are loaded into the loading chamber 11 when the door 18 is opened and the door 17 between the loading chamber 11 and the staging chamber 12 is sealed.

In one embodiment, sealed glove ports (not shown) in the exterior walls of the confined structure 10 enable the container assemblies 21 to be handled within the loading chamber 11 when the door 18 is sealed so that the container assemblies 21 can be loaded onto the tracks 20 within the loading chamber 11. In an alternative embodiment (not shown), an automated system within the loading chamber 11 loads the container assemblies 21 onto the tracks 20 when the door 18 is sealed.

The confined structure 10 includes an air conditioning system 24 for maintaining an uncontaminated environment within each of the staging chamber 12, the filling chamber 13 and the sealing chamber 14 by separately moving an uncontaminated gas through each of the staging chamber 12, the filling chamber 13 and the sealing chamber 14 at a pressure that is greater than the pressure outside of the confined structure 10. In the preferred embodiment, the air conditioning system 24 moves the uncontaminated gas through the filling chamber 13 at a pressure that greater than the pressure outside of the filling chamber 13.

The confined structure 10 also includes a gas collection, treatment and supply system 25 for collecting the gas that has been moved separately through each of the staging chamber 12, the filling chamber 13 and the sealing chamber 14 by the air conditioning system 24, treating the collected gas to assure that it is uncontaminated, and supplying the treated gas to the air conditioning system 24 for re-circulation through such chambers 12, 13, 14.

The given material to be inserted into the container assemblies 21 is provided from a tank (not shown) to a flexible conduit 26 via a hose (not shown) and a sterile coupling assembly 27. The conduit 26 is coupled to a material-insertion device 28 within the confined structure 10. A pump 29 is coupled to the conduit 26 for pumping a metered predetermined quantity of the given material into the material-insertion device 28 for insertion into each container assembly 21 that is moved into the filling chamber 13.

The material-insertion device 28 is disposed within the filling chamber 13 for inserting the given material through into a container assembly 21 that is in a position within the filling chamber 13 that is directly beneath the material-insertion device 28.

Operation of the pump 29 is controlled by a pump-control system 30, which includes a pump motor (not shown). Operation of the material-insertion device 28 and coordinated operation of the pump-control system 30 are controlled by an insertion-control system 31, which is coupled to the insertion device 28 by a drive shaft 32. A motor (not shown) within the insertion-control system 31 is coupled to the drive shaft 32.

The flexible conduit 26, the sterile coupling assembly 27, the pump 29, the pump-control system 30 and the insertion-control system 31 are contained in a housing 33 that can be separated from the confined structure 10 in order to gain access to the insertion device 28.

Referring to FIGS. 2-6, a preferred embodiment of the container assembly 21 includes an uncontaminated reservoir 34, an uncontaminated sleeve 35 and an uncontaminated film 36. There is an opening at the top of the reservoir 34. The sleeve 35 has a lower portion 37 that is sealed to the reservoir 34 and extends from the reservoir opening and an upper portion 38 that is sealed to a collar 39. The film 36 is secured to the collar 39 by a ring 40 that is sealed within a step at the uppermost portion of the collar 39. The step is of a wider diameter than the adjoining lower portion of the collar 39. Accordingly, the upper portion 38 of the sleeve 35 is sealed by the film 36.

In the preferred embodiment, the reservoir 34, the collar 39 and the ring 40 are made of a hard plastic material by injection molding and the sleeve 35 is made of a flexible plastic material by extrusion. In an alternative embodiment, the sleeve 35 is also made of a hard plastic material by injection molding.

The film 36 is a thin film. Penetration of the thin film 36 to break the seal thereby opens a passage through the sleeve 35 to the reservoir opening and enables insertion of the given material into the reservoir 24.

The container assembly 21 also includes a first set of carrier arms 41 that are attached to the upper portion 38 of the sleeve 35 by the collar 39 and a second set of carrier arms 42 that are attached to the reservoir 34 by another collar 43 around the upper portion of the reservoir 34. The first set of carrier arms 41 facilitates the movement of the container assemblies 21 via the first set of tracks 20. The second set of carrier arms 42 facilitates handling and/or movement of the reservoir 34 after the reservoir 34 is separated from the upper portion 38 of the sleeve 35, to which the first set of carrier arms 41 are attached. Such separation is described below with reference to FIGS. 9 and 10.

In a preferred embodiment the first set of carrier arms 41 contain magnetically attractive material 44 for cooperating with a magnetic-levitation transport system to facilitate movement of the container assemblies 21 along the path of the first set of tracks 20. The magnetically attractive material 44 is contained within cavities within the first set of carrier arms 41. The first set of carrier arms 41 is formed by sealing an upper component 41*a* to a lower component 41*b*.

A magnetic-levitation transport system is relatively frictionless and thereby diminishes the probability of the environment within the staging chamber 12, the filling chamber 13 and the sealing chamber 14 being contaminated by movement of the container assemblies 21. In other embodiments other types of transport systems, including both frictionless and non-frictionless transport systems may be used to move the container assemblies.

Figure 7:
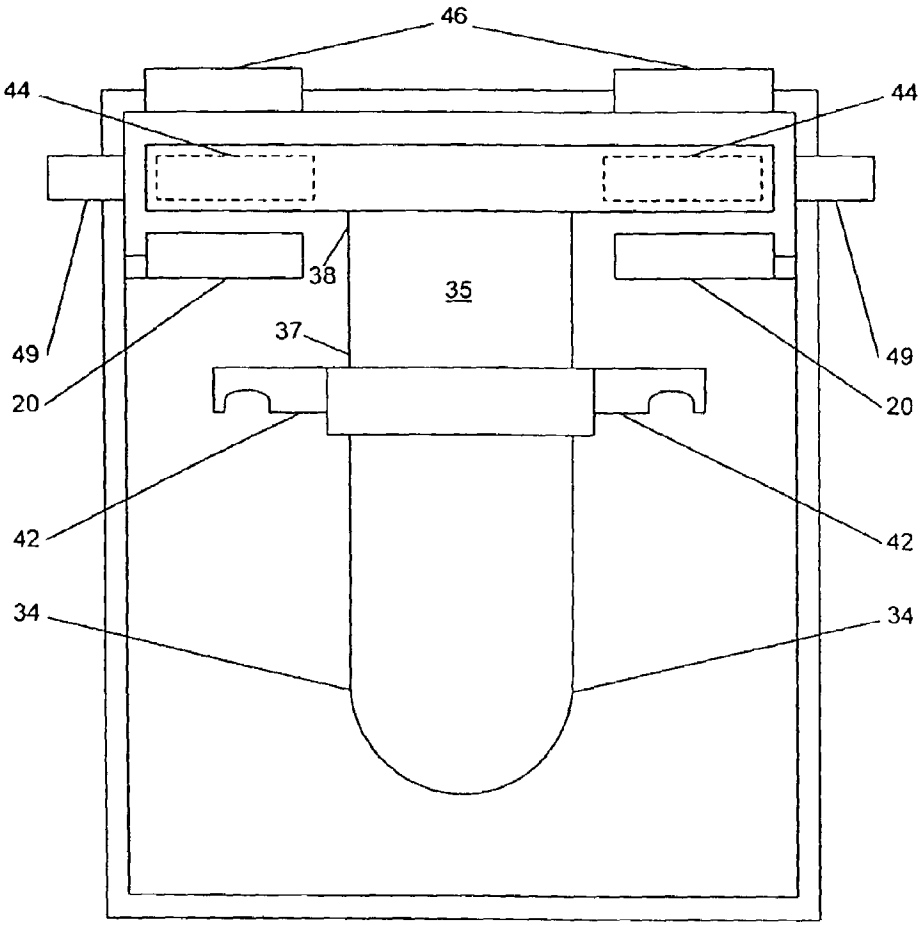
FIG. 7 is a functional end view of the carrier assembly of FIG. 2 within the staging chamber of the confined structure of FIG. 1 showing the carrier arms of the carrier assembly disposed in relation to a preferred embodiment of an apparatus for facilitating movement of the container assembly within the confined structure.

Referring to FIG. 7, a preferred embodiment of the magnetic-levitation transport system includes the first set of tracks 20 disposed beneath the first set of carrier arms 41 and a pair magnetic strips 46 disposed above the first set of carrier arms 41. Each of the first set of tracks 20 includes a series of segments of magnetic material that can be so controlled that adjacent segments are of opposite magnetic polarity. The polarity of each of the adjacent segments is periodically reversed to cause the magnetic segments to so interact with the magnetically attractive material 44 within the first set of carrier arms 41 as to cause the container assemblies 21 to be moved along the path of the first set of tracks 20. Such movement of the container assemblies 21 is stopped by causing all of the segments of the first set of tracks 20 to be of the same magnetic polarity.

Such movement is stopped whenever a container assembly 21 is moved into the filling chamber 13 from the staging chamber 12 and whenever a container assembly 21 is moved into the sealing chamber 14 from the filling chamber 13.

The pair of magnetic strips 46, which are disposed above the first set of carrier arms 41, attract the magnetically attractive material 44 within the first set of carrier arms 41 and thereby cause the first set of carrier arms 41 to be levitated above the first set of tracks 20 while the carrier assemblies 21 are being moved along the path of the first set of tracks 20.

Another pair of magnetic strips 49 are disposed at opposite the sides of the carrier arms 41 in order to minimize lateral movement of the levitated container assemblies 21 while the carrier assemblies 21 are being moved along the path of the first set of tracks 20.

In an alternative embodiment (not shown) utilizing a low-friction transport system that does not utilize levitation, the first set of tracks 21 further includes ball bearings in the upper surface of the tracks 21 and magnetic strips 46 are not disposed above the first set of carrier arms 41. In other respects, the tracks 21 and the carrier arms 41 containing magnetically attractive material 44 are constructed in the same manner as described above with reference to FIG. 7. In this alternative embodiment the carrier arms 41 ride along the ball bearings and are moved by magnetic propulsion along the path of the first set of tracks 20 in the same manner as described with reference to FIG. 7.

Referring to FIGS. 8A, 8B, 8C and 8D, a preferred embodiment of the material-insertion device 30 within the confined structure 10 (FIG. 1) includes a nozzle 50, a sleeve 51, a flexible pleated tube 52 and a casing 54. One end of the flexible pleated tube 52 is sealed to the flexible conduit 26 and the other end of the flexible pleated tube 52 is sealed to the top of the nozzle 50. The nozzle 50, the sleeve 51 and the flexible pleated tube 52 are disposed within the casing 54. The casing 54 has a cylindrical side wall 56, a wall 57 at the top of the side wall 56, a pair of doors 58 at the bottom of the side wall 56, a movable collar 60 on the outside of the side wall 56 near the bottom thereof, and a collar stop 62 on the outside of the sidewall 56 above the movable collar 60.

Both the nozzle 50 and the sleeve 51 are coupled to the drive shaft 32. The nozzle 50 is disposed within the sleeve 51 and is removably coupled to the sleeve 51 for either moving vertically together with the sleeve 51 or moving vertically separately from the sleeve 51. The nozzle is movable vertically with respect to the sleeve 51 when the nozzle 50 is decoupled from the sleeve 51. The drive shaft 32 is a keyed drive shaft that is rotatable about its axis to engage or disengage keys (not shown) within the nozzle 50 and the sleeve 51 in order to selectively couple or decouple the nozzle 50 and the sleeve 51 to thereby control whether the nozzle 50 is moved together with or separately from the sleeve 51.

In alternative embodiments (not shown) other systems can be used to control the respective movements of the nozzle 50 and the sleeve 51.

Figure 8D:
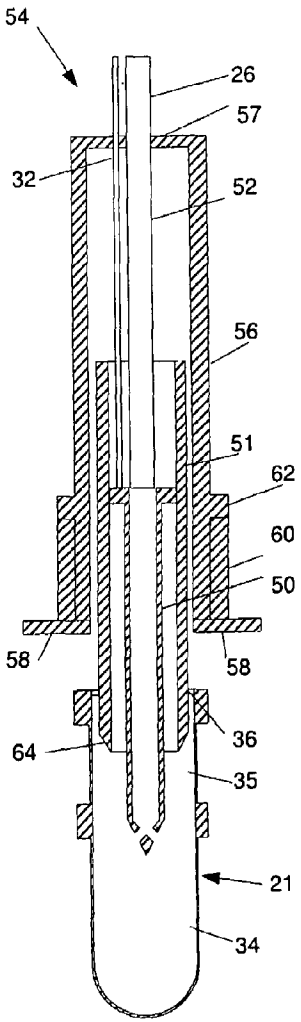
FIG. 8D is a sectional side view corresponding to the views of FIGS. 8A, 8B and 8C, wherein the nozzle of the insertion device has been protracted to the opening of the reservoir of the container assembly to facilitate inserting material into the reservoir of the container assembly.
Figure 8C:
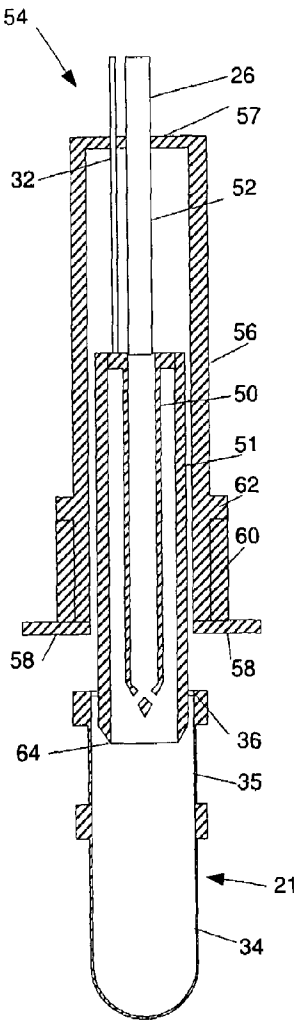
FIG. 8C is a sectional side view corresponding to the views of FIGS. 8A and 8B, wherein a sleeve and a nozzle of the insertion device have been protracted into the sleeve of the container assembly.
Figure 8B:
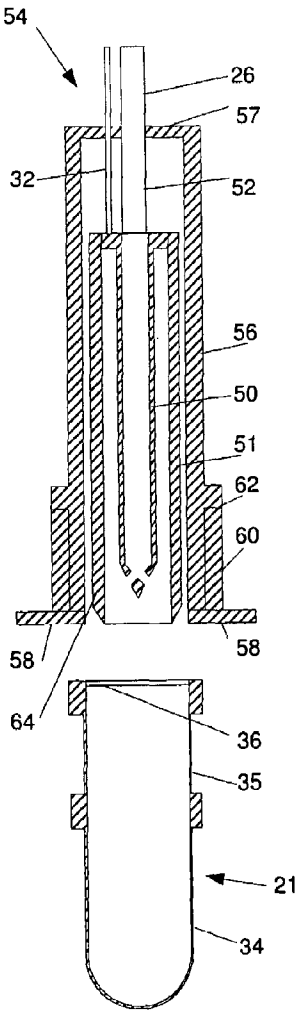
FIG. 8B is a sectional side view corresponding to the view of FIG. 8A, wherein the casing of the insertion device has been opened.
Figure 8A:
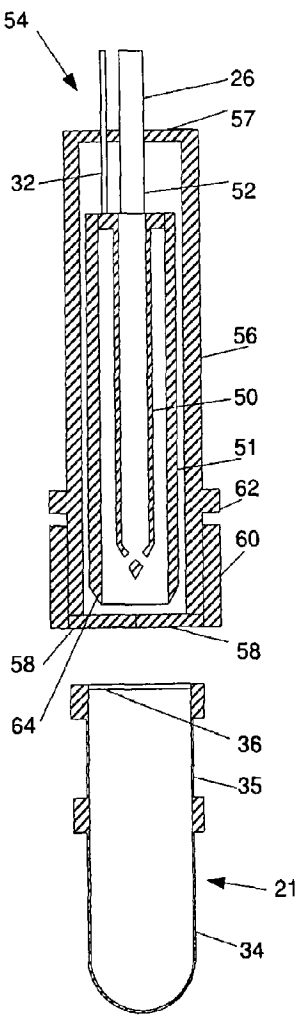
FIG. 8A is a sectional side view showing the disposition of the container assembly of FIG. 2 in the filling chamber in combination with a preferred embodiment of a material-insertion device, wherein the casing of the material-insertion device is closed.

The movable components 50, 51, 52, 58, 60 of the material-insertion device 28 are disposed in relation to one another and the sidewall 56 as shown in FIG. 8A when the door 17 between the staging chamber 12 and the filling chamber 13 is opened to enable a container assembly 21 to be moved into the filling chamber 13 from the staging chamber 12 and when the door 17 between the sealing chamber 14 and the filling chamber 13 is opened to enable a container assembly 21 to be moved from the filling chamber 13 into the sealing chamber 14.

After the container assembly 21 has been moved into the filling chamber 13 from the staging chamber 12 and the door 17 between the staging chamber 12 and the filling chamber 13 has been sealed to provide an airlock within the filling chamber 13, the movable collar 60 is moved upward to engage the collar stop 62 and the doors 58 are opened, as shown in FIG. 8B.

The sleeve 51 and a nozzle 50 of the insertion device are then protracted into the sleeve 35 of the container assembly 21, as shown in FIG. 8C. The insertion-device sleeve 51 includes a sharp lower edge 64 for penetrating the film 36 to break the seal and thereby open the container-assembly sleeve 35 when the insertion-device sleeve 51 is protracted downward into the container-assembly sleeve 35. The outer diameter of the insertion-device sleeve 51 is slightly less than the inner diameter of the container-assembly sleeve 35 so that the insertion-device sleeve 51 is snuggly engaged within the container-assembly sleeve 35.

Next, the nozzle 50 is decoupled from the insertion device sleeve 51 by rotation of the drive shaft 32 and then further protracted through the container-assembly sleeve 35 to the opening of the reservoir 34 of the container assembly 21, as shown in FIG. 8D, to facilitate insertion of the given material into the reservoir 34. The pump 29 is then operated to pump a predetermined quantity of the given material through the conduit 26, the tube 52 and the nozzle 50 into the reservoir 34 of the container assembly 21.

After the reservoir 34 of a container assembly 21 has been filled, the nozzle 50 and the insertion-device sleeve 51 are retracted to the positions thereof shown in FIG. 8B, and the doors 58 are then closed as shown in FIG. 8A.

Next, the door 17 between the filling chamber 13 and the sealing chamber 14 is opened and the container assembly 21 including the filled reservoir 34 is moved into the sealing chamber 14. During the interval of such movement, the door 17 between the staging chamber 12 and the filling chamber 13 is also opened and another container assembly 21 is moved into the filling chamber 13 from the staging chamber 12.

Figure 9:
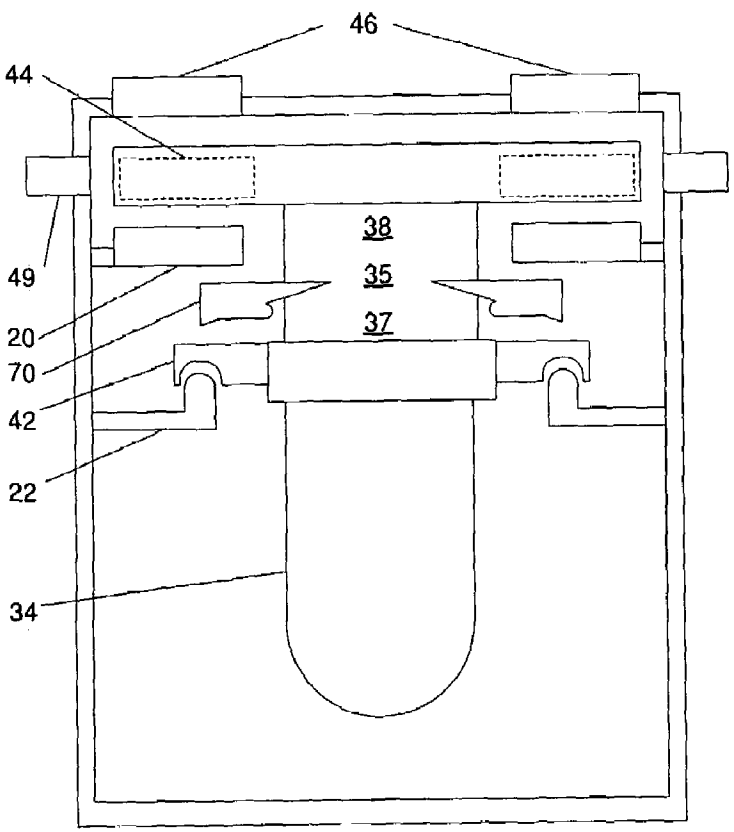
FIG. 9 is a functional end view of the carrier assembly of FIG. 2 within the sealing chamber of the confined structure of FIG. 1, taken during the severing of the sleeve of the container assembly.

Referring to FIG. 9 a movable heated severing and sealing device 70 is included within the sealing chamber 14. The device 70 is moved to engage the sleeve 35 of a container device that has been moved into the sealing chamber 14 from the filling chamber 13. Upon engaging the sleeve 35, the heated severing and sealing device 70 pinches and thereby severs the sleeve 35 to separate the upper portion 38 of the sleeve 35 from the lower portion 37 of the sleeve 35 and thereby separate the portion of the container assembly 21 that includes the first set of carrier arms 41 from the portion of the container assembly 21 that includes the reservoir 34.

Figure 10:
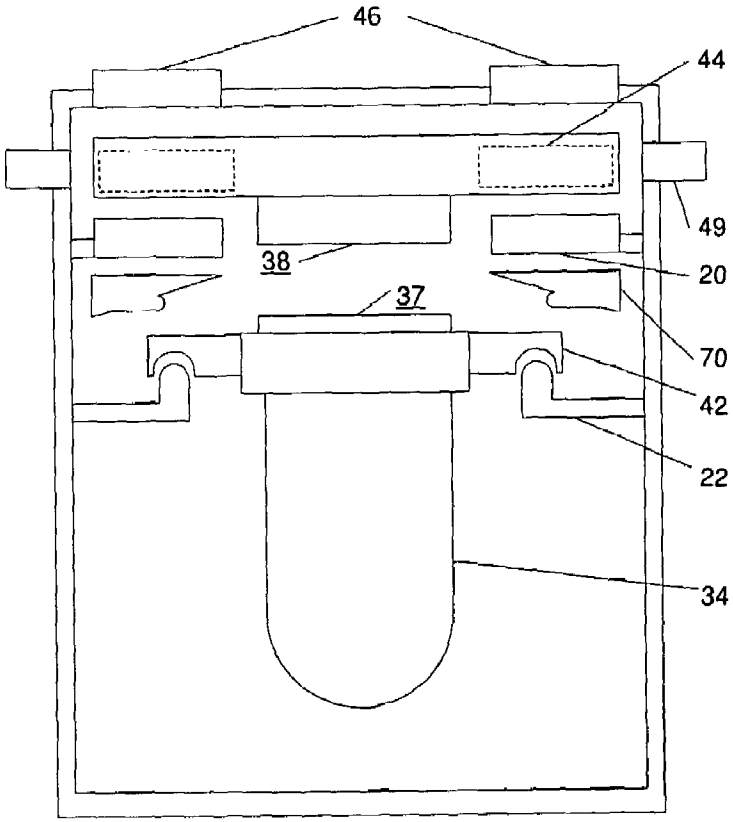
FIG. 10 is a functional end view of the carrier assembly of FIG. 2 within the sealing chamber of the confined structure of FIG. 1, taken after the sleeve of the container assembly has been severed.

After the upper portion 38 of the sleeve 35 has been separated from the lower portion 37 of the sleeve 35, the heated severing and sealing device 70 seals the lower portion 37 of the sleeve 35, and is then moved away from the separated portions of the container assembly 21, as shown in FIG. 10.

After the sleeve 35 has been severed to thereby separate the reservoir 34 from the first set of carrier arms 41, the second set of carrier arms 42, which is attached to the reservoir 34, facilitates handling of the reservoir 34 and/or movement of the reservoir 34 via the second set of tracks 22 along a route that is different than the route defined by the first set of tracks 20 along which the separated upper portion 38 of the sleeve 35 is moved away from the severing and sealing device 70.

In a preferred embodiment, the second set of carrier arms 42 includes grooves 72 for engaging the second set of tracks 42; and the separated reservoir 34 is moved along the second set of tracks by either gravity or by a mechanical transport system (not shown). In an alternative embodiment (not shown) the second set of carrier arms 42 includes magnetically attractive material, such as included in the first set of carrier arms 41 and the second set of tracks includes segments of magnetic material, such as included in the first set of tracks 20, so that the separated reservoir 34 can be moved along the second set of tracks 22 by a magnetic-propulsion transport system.

Figure 11:
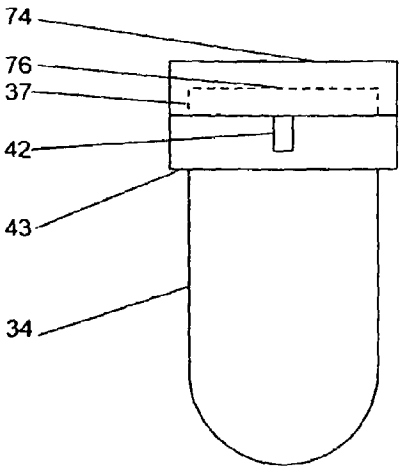
FIG. 11 is a side view of one preferred embodiment of the reservoir of the container assembly after the sleeve has been severed and sealed, with a cap having been applied thereto in order to cover the sealed sleeve.

Referring to FIG. 11, a removable cap 74 is applied to cover the sealed lower portion 37 of the sleeve 35 that remains attached to the filled reservoir 34. The reservoir 34 includes a section 76 having a thin wall that can be penetrated by a syringe.

Figure 12:
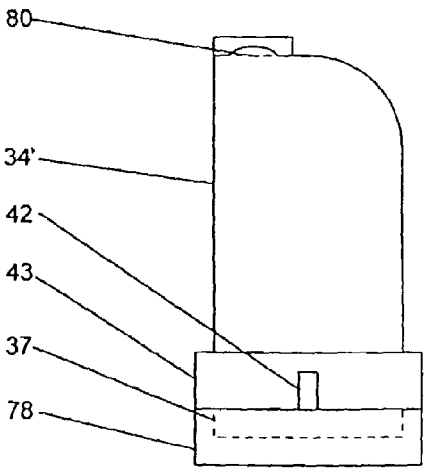
FIG. 12 is a side view of another preferred embodiment the reservoir of the container assembly after the sleeve has been severed and sealed, with a base having been applied thereto in order to cover the sealed sleeve.

Referring to FIG. 12 a base 78 is applied to cover the sealed lower portion 37 of the sleeve 35 that remains attached to the filled reservoir 34'; and the reservoir 34' can rest upon the base 78. The reservoir 34' includes a section 80 having a thin wall that can be penetrated by a syringe. Preferably, the thin wall 80 is covered by a removable cap (not shown).

The benefits specifically stated herein do not necessarily apply to every conceivable embodiment of the present invention. Further, such stated benefits of the present invention are only examples and should not be construed as the only benefits of the present invention. While the above description contains many specificities, these specificities are not to be construed as limitations on the scope of the present invention, but rather as examples of the preferred embodiments described herein. Other variations are possible and the scope of the present invention should be determined not by the embodiments described herein but rather by the claims and their legal equivalents. The claims require no implicit limitations. Each claim is to be construed explicitly as stated, or by its legal equivalent.

Regarding the method claims, except for those steps that can only occur in the sequence in which they are recited, and except for those steps for which the occurrence of a given sequence is specifically recited or must be inferred, the steps of the method claims do not have to occur in the sequence in which they are recited.

The invention claimed is:

1. A container assembly comprising:

an uncontaminated reservoir;

an uncontaminated sleeve;

carrier arms attached to a portion of the sleeve for facilitating movement of the carrier assembly via a set of tracks; and an uncontaminated film;

wherein there is an opening at the top of the reservoir;

wherein the sleeve has a lower portion that extends from the reservoir opening and an upper portion that is sealed by the film;

wherein penetration of the film to break the seal thereby opens the sleeve and enables insertion of a material into the uncontaminated reservoir; and wherein the reservoir is separable from the portion of the sleeve to which the first recited carrier arms are attached, the container assembly further comprising:

a second set of carrier arms attached to the reservoir for facilitating handling and/or movement of the reservoir via a set of tracks after the reservoir is separated from the portion of the sleeve to which the first recited carrier arms are attached.

2. A container assembly according to claim 1, wherein the second set of carrier arms includes grooves for engaging a set of tracks.

3. A container assembly comprising:

an uncontaminated reservoir;

an uncontaminated sleeve; and an uncontaminated film;

wherein there is an opening at the top of the reservoir;

wherein the sleeve has a lower portion that extends from the reservoir opening and an upper portion that is sealed by the film;

wherein penetration of the film to break the seal thereby opens the sleeve and enables insertion of a material into the uncontaminated reservoir; and wherein an upper portion of the sleeve is sealed to a collar and the film is secured to the collar by a ring that is sealed within a step at the uppermost portion of the collar, the step being of a wider diameter than an adjoining lower portion of the collar so that the upper portion of the sleeve is sealed by the film.

4. A container assembly according to claim 3, wherein the upper portion of the sleeve is separable from the lower portion of the sleeve.

5. A container assembly according to claim 4, further comprising:

carrier arms attached to the upper portion of the sleeve for facilitating movement of the carrier assembly via a set of tracks.

6. A container assembly according to claim 5, further comprising:

a second set of carrier arms attached to the reservoir for facilitating handling and/or movement of the reservoir via a set of tracks after the upper portion of the sleeve is separated from the lower portion of the sleeve.

7. A container assembly according to claim 6, wherein the second set of carrier arms includes grooves for engaging a set of tracks.

8. A container assembly according to claim 4, further comprising a cap for covering the lower portion of the sleeve after the upper portion of the sleeve is separated from the lower portion of the sleeve.

9. A container assembly according to claim 3, wherein the reservoir includes a section having a thin wall that can be penetrated by a syringe.

10. A container assembly according to claim 4, further comprising a base for covering the lower portion of the sleeve after the upper portion of the sleeve is separated from the lower portion of the sleeve so that the reservoir can rest on the base.

11. A container assembly according to claim 10, wherein the reservoir includes a section having a thin wall that can be penetrated by a syringe.

12. A container assembly according to claim 11, further comprising a removable cap for covering the thin section of the reservoir.

13. A container assembly according to claim 3, further comprising:

carrier arms attached to a portion of the sleeve for facilitating movement of the carrier assembly via a set of tracks.

14. A container assembly according to claim 3, further comprising:

carrier arms containing magnetically attractive material for cooperating with magnetic-levitation transport means to facilitate movement of the container assembly via a set of tracks.

15. A container assembly according to claim 3, further comprising:

a set of carrier arms attached to the reservoir for facilitating handling and/or movement of the reservoir via a set of tracks.

16. A container assembly according to claim 15, wherein the set of carrier arms includes grooves for engaging a set of tracks.

17. A container assembly according to claim 3, wherein the reservoir includes a section having a thin wall that can be penetrated by a syringe.

18. A container assembly according to claim 3, wherein the film is a thin film.

19. A container assembly according to claim 3, wherein said material has not been inserted into the uncontaminated reservoir.

* * * * *

UNITED STATES PATENT AND TRADEMARK OFFICE

CERTIFICATE OF CORRECTION

PATENT NO. : 7,743,800 B1
APPLICATION NO. : 11/635744
DATED : June 29, 2010
INVENTOR(S) : Nathan Albert Cole It is certified that error appears in the above-identified patent and that said Letters Patent is hereby corrected as shown below:

Column 8, line 49, "3" should be --8--.

Signed and Sealed this

Sixteenth Day of November, 2010

David J. Kappos

David J. Kappos
*Director of the United States Patent and Trademark Office*